United States Patent [19]

Stehling

[11] Patent Number: 5,033,501

[45] Date of Patent: Jul. 23, 1991

[54] FIRE HYDRANT CAP AND ACTUATING TOOL THEREFOR

[75] Inventor: Henry Stehling, Irving, Tex.

[73] Assignee: Hydra-Shield Manufacturing, Inc., Irving, Tex.

[21] Appl. No.: 622,070

[22] Filed: Dec. 4, 1990

[51] Int. Cl.[5] ..... F16K 35/10; E03B 9/06

[52] U.S. Cl. ..... 137/296; 7/138; 81/125; 81/176.15; 137/381; 137/800; 184/5; 220/85 P; 220/284; 403/19; 411/405; 411/432; 411/911

[58] Field of Search ..... 7/138, 166; 81/55, 125, 81/176.1, 176.15, 176.2, 487; 137/296, 371, 377, 381, 382, 382.5, 800; 215/213, 215; 220/85 P, 284; 222/182; 184/5, 100, 105.3; 403/19; 411/405, 429, 432, 910, 911

[56] References Cited

U.S. PATENT DOCUMENTS

| | | | |
|---|---|---|---|
| 609,324 | 8/1898 | Atkinson | 81/55 |
| 1,136,755 | 4/1915 | Baker | 81/55 |
| 2,514,799 | 7/1950 | Rubertino et al. | 184/105.3 |
| 3,872,662 | 3/1975 | Atwood et al. | 184/100 |
| 3,929,152 | 12/1975 | Graham | 137/296 |
| 3,935,877 | 2/1976 | Franceschi | 137/296 |
| 4,182,361 | 1/1980 | Oakey | 137/296 |
| 4,526,193 | 7/1985 | Drach | 137/800 |
| 4,566,481 | 1/1986 | Leopold, Jr. et al. | 137/296 |
| 4,618,299 | 10/1986 | Bainbridge et al. | 411/910 |
| 4,651,771 | 3/1987 | Borenstein et al. | 137/296 |

*Primary Examiner*—George L. Walton
*Attorney, Agent, or Firm*—Millen, White & Zelano

[57] ABSTRACT

A fire hydrant cap and actuating tool for use therewith provide enhanced security for fire hydrants and increased safety when using the tool. The cap is forged of 8620 carbon steel; is provided with an internal steel lock washer of cadmium plate steel, and includes thereon a forged, external slip ring of 8620 carbon steel with lubrication between the slip ring and cap. The tool which is used in combination with the cap includes a gripper which fits under the slip ring to prevent the tool from slipping, a spanner wrench and a hexagonal socket with a screw for gripping rounded-off valve stems.

11 Claims, 4 Drawing Sheets

FIRE HYDRANT CAP AND ACTUATING TOOL THEREFOR

BACKGROUND OF THE INVENTION

The instant invention relates to fire hydrant caps and actuating tools for use therewith. More particularly, the instant invention relates to fire hydrant caps and actuating tools for use therewith wherein security provided by the caps is enhanced while use of activating tools for the caps is made safer.

In many communities, fresh water has become, or is becoming, a valuable commodity which is metered to its users. A ubiquitous source of fresh water in urban and suburban communities is the enormous number of fire hydrants distributed throughout these communities. In order to protect such communities from fire, these hydrants must be readily available to fire departments. Unfortunately, in many areas, hydrants are opened by residents and others in order to obtain quantities of fresh water, sometimes for recreational purposes and at other times for sale to fresh water users. For example, tanker trucks frequently fill illegally at fire hydrants and sell stolen water to swimming pool owners. From time to time vandals damage, open and waste water from fire hydrants for no rational purpose whatsoever.

In order to protect water supplies and prevent fire hydrants from being opened by people other than those having authority to do so, vandal-proof security arrangements have been developed. For example, U.S. Pat. No. 3,929,152 to Graham discloses a vandal-proof cap which is in wide use throughout the United States. This vandal-proof cap relies upon a steel cap which is threaded on the outlet of a fire hydrant. The steel cap has a dome shaped outer surface with a series of grooves therein which require the use of a special wrench having a gripping portion with shoulders for engaging the grooves. The cap of Graham has been improved over the years by providing a slip ring which minimizes the effectiveness of band-type wrenches or other large wrenches in illegally removing the cap. Unfortunately, vandals are beginning to defeat the Graham device by pounding the slip ring with a sledge hammer to weld the slip ring to the cap so that purchase of the slip ring with the cap enables one to apply sufficient torque to remove the cap with tools other than the specially configured tool provided only to fire departments.

In addition, it has been found that the specially configured tool or wrench utilized to back the cap off can slip from the cap. Since the wrench is large and the torque applied by the wrench is considerable, if the wrench slips there is risk of injury to the firemen using the wrench and to any one standing near the wrench.

In view of the aforementioned considerations, there is need for improvement in the original Graham arrangement.

SUMMARY OF THE INVENTION

It is an object of the instant invention to provide a new and improved fire hydrant cap and actuating tool for use therewith.

In view of this object and other objects, the instant invention comprises an improvement in the fire hydrant cap disclosed in U.S. Pat. No. 3,929,152 by utilizing a cadmium plated, steel lock washer within the cap and a forged carbon steel slip ring around the periphery of the cap.

The invention further contemplates providing lubrication between the slip ring and cap and fabricating both the cap and slip ring as forgings of 8620 carbon steel.

In addition, the instant invention comprises an actuating tool in combination with the cap wherein the actuating tool includes a gripper for seating behind the slip ring in order to minimize the possibility of the actuating tool slipping from the cap when the torque is applied through the tool.

Upon further study of the specification and appended claims, further objects and advantages of this invention will become apparent to those skilled in the art.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
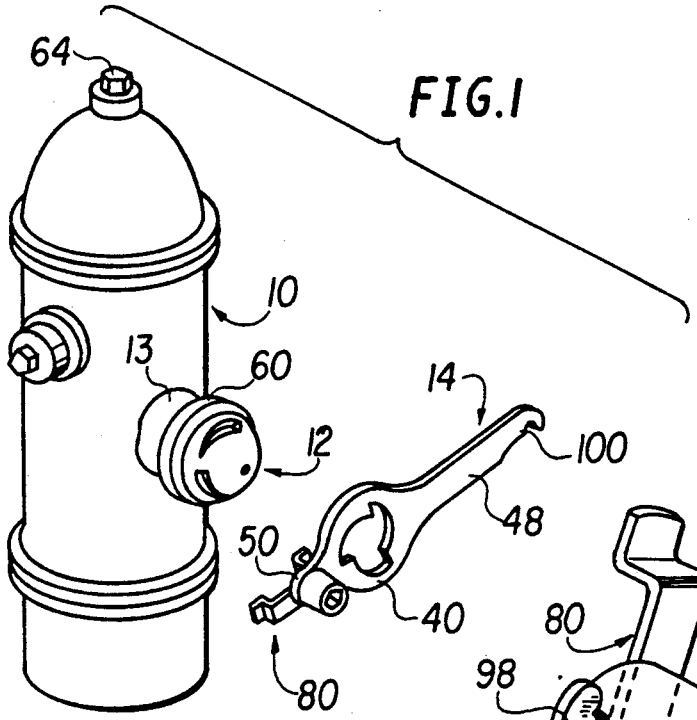
FIG. 1 is a perspective view, showing the fire hydrant cap of the instant invention in place on a fire hydrant and an actuating tool of the instant invention in position to engage the cap.
Figure 8:
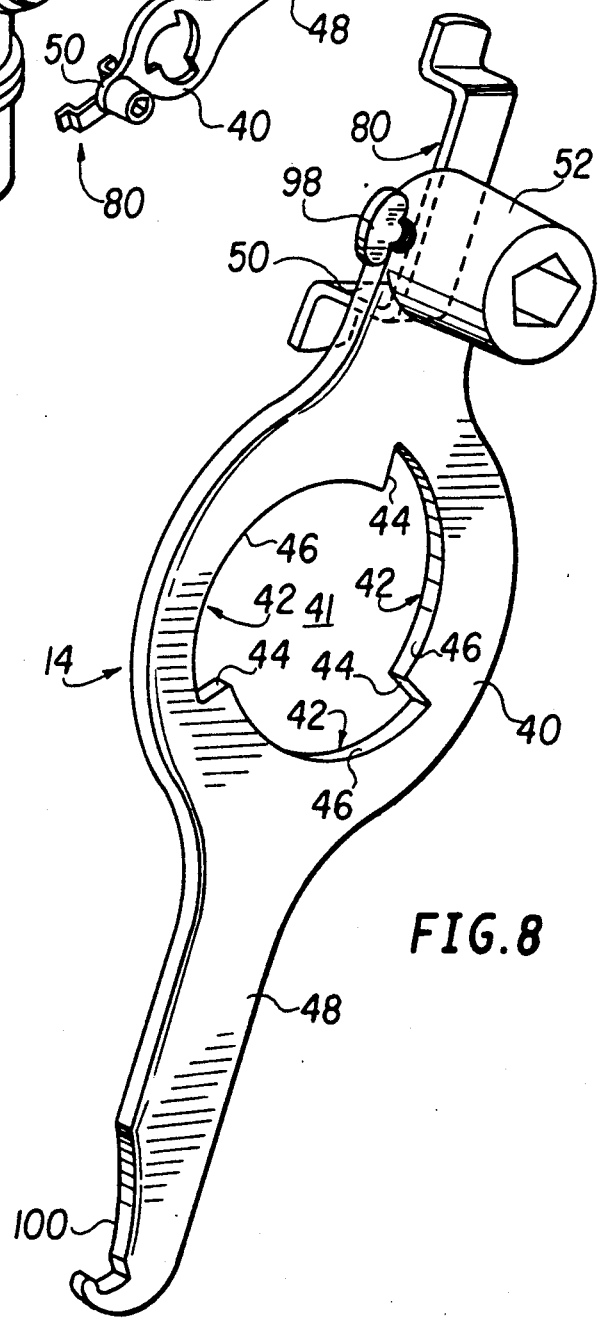
FIG. 8 is an enlarged perspective view of the actuating tool of the instant invention.

Referring now to FIG. 1, there is shown a fire hydrant, designated generally by the numeral 10, upon which is threaded a fire hydrant cap, designated generally by the numeral 12. The cap 12 is threaded on external threads of an outlet 13 by rotating the cap in the clockwise direction with an actuating tool, designated generally by the numeral 14.

Referring now to FIGS. 2–7 in combination with FIG. 1, it is seen that the fire hydrant cap 12 has a body portion 20 with a planar back surface 22 and a dome-shaped front portion 24 which faces outwardly. The cap 12 is hollow and includes an inner surface, designated generally by the numeral 25, having a threaded portion 26 and a cavity 27. Seated within the cavity 27 against an internal annular shoulder 28 is a split steel ring 29 (FIGS. 6 and 7) which binds with the threaded end of the outlet 13 when the cap 12 is tightened thereon by the wrench 14.

The dome-shaped surface 24 provides a curved, convex shape which is not readily engageable with conventional tools, such as wrenches having parallel jaws, and includes no sharp corners or edges which can be engaged by chisels for unthreading the cap. Preferably, the domed surface 24 is in the form of a sector of a sphere, although any curved convex surface may be utilized which cannot be easily gripped by conventional tools and rotated off the fire hydrant outlet 13.

In order to rotate the cap 12 so as to thread onto and off the externally threaded outlet 13 of the fire hydrant 10, a plurality of tool engaging surfaces, generally designated by the reference numerals 30, are positioned on the domed surface 24 of the cap. Each tool engaging surface 30 includes a shoulder 32 facing oppositely to the direction in which the cap is threaded onto the hydrant outlet 13 for providing surfaces engageable by the tool 14. The internal threads 26 within the cavity 25 of the cap 12 are usually threaded for right-hand rotation and thus the shoulders 32 are oriented to face in a counterclockwise direction around the longitudinal axis 34 of the cap 12 to provide surfaces for engagement by an actuating tool used for threading and tightening the cap 12 onto the outlet 13. While the shoulders 32 may be engaged by tools such as chisels and hammers, any force applied to the shoulders 32 will always be in a direction for tightening the cap 12 onto the outlet 13. The shoulders 32 cannot be engaged by any conventional wrench for unthreading the cap 12.

Each of the engaging surfaces 30 also include recesses 34 extending from each shoulder 32 in a direction opposite to the direction in which the cap 12 is threaded onto the hydrant outlet 13. Each recess 34 includes a curved surface 36 extending from the shoulder 32 and progressively increasing in radial distance from the longitudinal axis 34 of the body 20 for providing a surface for coacting with the actuating tool 14. It is emphasized that the curved surfaces 36 do not provide a gripping surface for engagement by any conventional tools for unthreading the cap 12.

Figure 2:
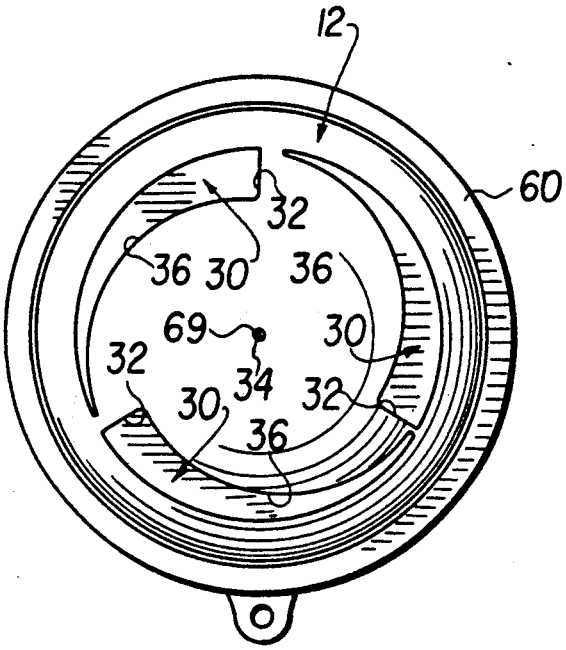
FIG. 2 is an enlarged end view of one end of the fire hydrant cap of FIG. 1.

As is best seen in FIG. 2, it is preferred to provide three engaging surfaces 30 spaced an equal distance of approximately 120° apart around the domed surface of the cap 12.

Referring now more specifically to FIGS. 1, 3 and 8–10, the actuating tool 14 for threading and unthreading the cap 12 from the hydrant 10 includes a ring portion 40 which is preferably circular. The ring portion 40 includes an internal opening 41 for fitting around the domed surface 24 of the cap 12 and includes a plurality of actuating surfaces, generally indicated by the numeral 42. The number of actuating surfaces 42 are equal to the number of tool engaging surfaces 30 on the cap 12 coacting therewith. Each actuating surface 42 includes a shoulder 44 positioned to coact with one of the shoulders 32 of the cap 12. In addition, each of the actuating surfaces 42 also includes a curved portion 46 which extends from its respective shoulder 44 in a clockwise direction and progressively decreases in distance from the center of the ring portion 40 so as to coact with the curved surfaces 36 on the cap 12. Tool 14 also includes a handle 48 connected to the circular portion 40 for applying torque to the ring 40. At the end of the handle 48 is a hooked portion 49 which is configured as a spanner wrench to cooperate with other structures (not shown) associated with pumper equipment. Extending from the ring portion 40 in a direction opposite the handle 48 is a flange 50 which has a hexagonal socket 52 projecting therefrom which socket cooperates with the hexagonal valve stem 64 (FIG. 1) projecting from the top of the hydrant 10 in order to open the valve (not shown) within the hydrant to let water flow through the outlet 13 when the cap 12 is removed.

In operation, the actuating tool 14 is placed over the domed surface 24 to bring the shoulders 44 on the tool 14 into engagement with the shoulders 32 of the cap 12 so that rotation of the handle 14 in the clockwise direction will tighten the cap 24 onto the hydrant 10. When it is desired to remove the cap 12 from the hydrant 10, the actuating tool 14 is again fitted over the domed surface 24 of the cap 12, placing the curved portions 46 of the tool 14 in engagement with the curved surfaces 36 on the cap so that when the tool is rotated in a counterclockwise direction, the cap is unthreaded from the outlet 13.

Figure 5:
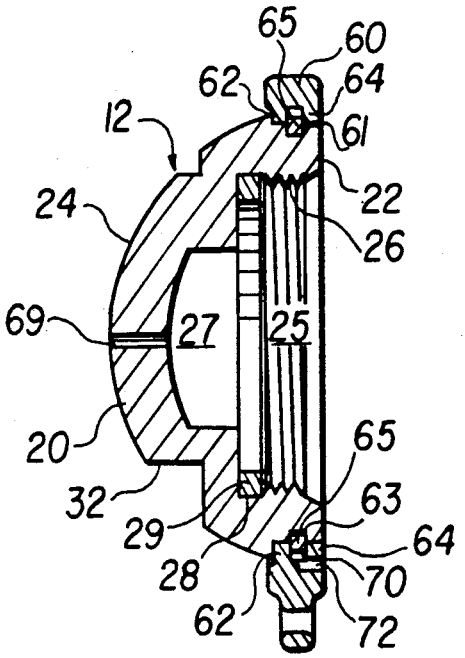
FIG. 5 is an enlarged cross-section of the cap according to the instant invention.
Figure 6:
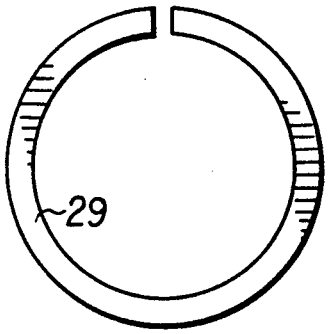
FIG. 6 is a planar view of the cadmium steel, split ring lock washer used in the cap of FIGS. 1–4.
Figure 7:
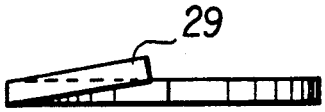
FIG. 7 is a side view of the lock washer of claim 6.
Figure 9:
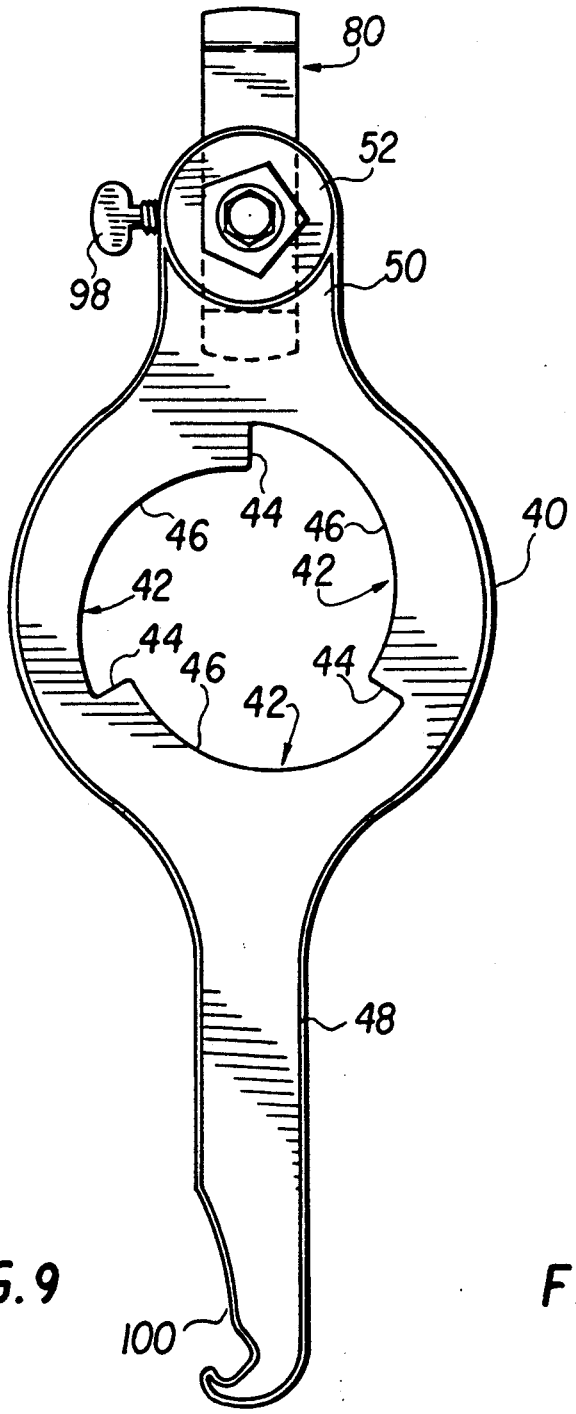
FIG. 9 is a planar view of the actuating tool of FIG. 6.
Figure 10:
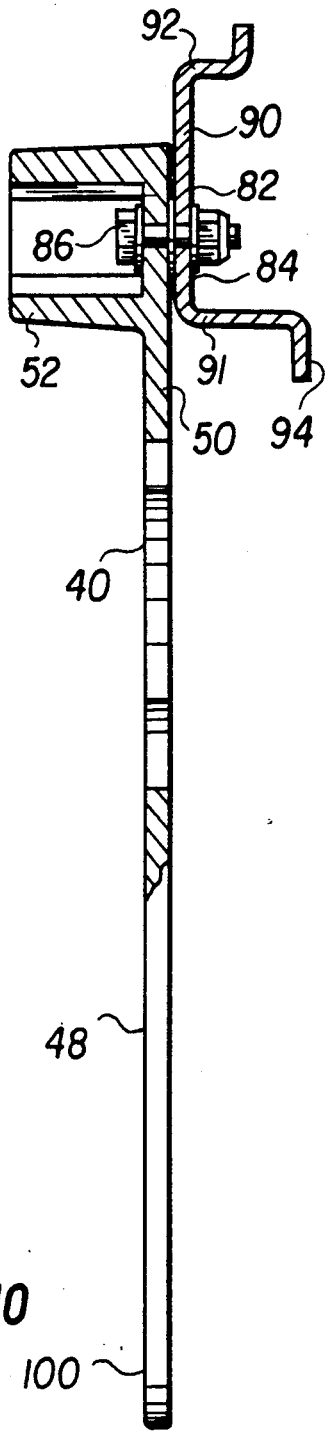
FIG. 10 is a side view of the actuating tool of FIGS. 7.

A number of features have now been provided to enhance the effectiveness and safety of caps such as the cap 12 and actuating tools such as the actuating tool 14. Referring now more specifically to FIGS. 5–7, in order to minimize the ability of an unauthorized person or vandal to unthread the cap 12 from the outlet 13, a slip ring 60 has been placed around the cap 12 adjacent the rear surface 22 thereof. If an attempt is made to grip the cap 12 with a band wrench or similar device where the curvature of the cap approaches the cylindrical surface of the outlet 13, slip ring 60 rotates with respect to the cap. In order to discourage vandals from welding the slip ring 60 to the surface of the dome shaped portion 24 by pounding the slip ring 60 with a sledge hammer or by jamming a wedge between the slip ring 60 and the surface 24, slip ring 60 is made of 8620 carbon steel as is the cap 12. The 8620 carbon steel of the slip ring and cap 12 are normalized at 1750° F. and drawn at 1150° F. and are then heat treated and carburized to a Rockwell "C" hardness in the range of 58–62 RC to a depth of 0.030".

To facilitate assembly, the slip ring 60 has an inner diameter equal to the outer diameter of a reduced diameter portion 61 of the cap 12. The domed portion 24 of the cap 12 ends abruptly with a shoulder 62 which extends inwardly to the reduced diameter portion 61 and is abutted by the slip ring 60 when the slip ring is slid over the reduced diameter portion 61 of the cap. An annular groove 63 is formed in the reduced diameter portion 61 of the cap 12 which groove is opposed by a complementary annular groove 64 in the slip ring 60. A split snap ring 65 of spring steel is received in both the grooves 63 and 64 to retain the slip ring 60 on the cap by preventing the slip ring from dislarging off the back end 22 of the cap. During assembly, the split snap ring 65 is spread into the groove 64 of the slip ring 60 so that the assembly of the slip ring and snap ring clears the reduced diameter portion 61 of the cap.

Unitary with the slip ring 60 is a hookeye 67 having an opening 68 therethrough for receiving a safety chain (not shown) so that the cap 12 can remain loosely attached to the fire hydrant 10 after the cap is unthreaded from the outlet 13.

The improved cap 12 includes a weep hold 69 connecting the cavity 27 to the atmosphere so as to equalize pressure between the atmosphere and the inside of the hydrant 10.

A space 70 is provided between the slip ring 60 and adjoining portions of the cap 12 to accommodate lubrication so that the ring will slip easily with respect to the cap. Access to the lubrication space 70 is provided by a bore 72 positioned behind hook eye lug 69 so that additional lubrication can be added from time to time to maintain slippage between the ring 60 and cap 12. An appropriate lubricant is #1242 lithium base grease. The lubricant works its way around the snap ring 65 and through the split in the snap ring so that the grooves 63 and 64 retain the lubricant. The resulting arrangement enhances the vandal resistance of the cap and prevents hard water corrosion buildup from locking the ring 60 to the cap. Moreover, lubrication provides for proper operation of the slip ring 60 over a longer period of time while the bore 72 allows the ring to be lubricated on site.

The split ring 29 shown in FIGS. 5–6 is a double zinc or cadmium-plated, steel lock washer which does not deteriorate over time (which was a problem with the previously used rubber washers). In addition, the steel lock washer 29 requires 150–160 foot pounds of torque to rotate the cap 12 with respect to the outlet 13, whereas the previously used rubber washer required only about 75 foot pounds. As is seen in FIG. 7, the lock washer 29 is offset approximately one thickness so as to apply pressure to the face of the outlet 13 of the fire hydrant 10.

Figure 3:
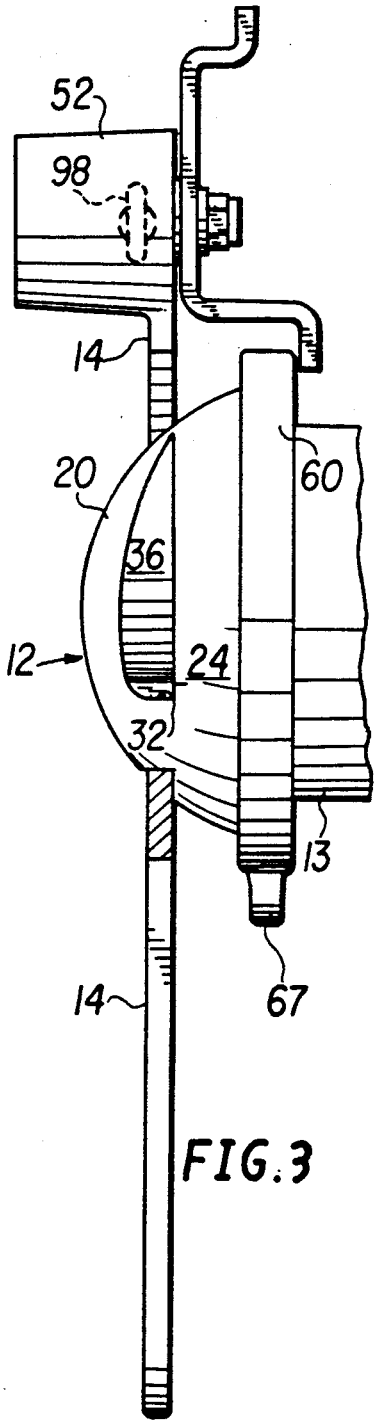
FIG. 3 is a cross-sectional view taken along line 3—3 of FIG. 2 including the actuating tool engaging the cap.
Figure 4:
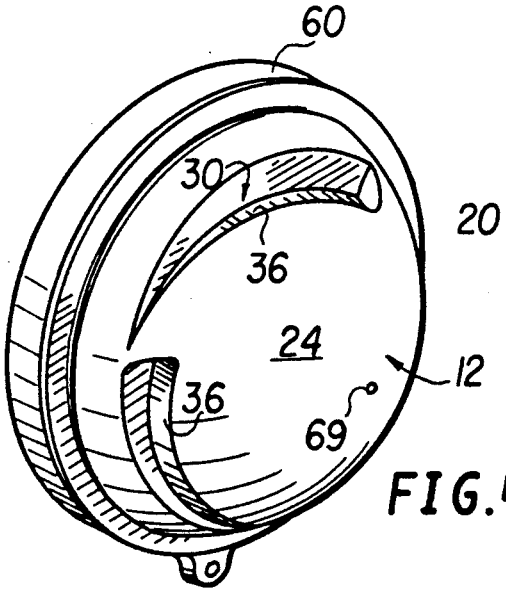
FIG. 4 is a perspective view of the fire hydrant cap of the instant invention.

The increased amount of torque necessary to dislodge the cap 12 from the outlet 13 increases the possibility for the wrench or actuating tool 14 slipping from the cap when attempting to remove the cap. In order to minimize this possibility, a gripping element, designated generally by the numeral 80 is pivoted on the handle 14. Preferably, the gripping element 80 is retained on the flange 50 by a bolt 82 passing through a hole 84 in the base of the hexagonal socket 52 (see FIG. 8). The bolt 82 has a nut 86 rotationally fixed with respect thereto so that the gripper 80 is freely rotatable on the bolt 82. The gripping element 80 has a generally U-shaped portion 90 with a long leg 91 and a short leg 92. Secured to the long leg 91 is a first flange 94 which, as seen in FIG. 3, fits behind the slip ring 60 and prevents the actuating tool 14 from slipping from the cap 12. The long leg 91 and first flange 94 are used for engaging caps 12 on four and one half inch outlets 13. The sort leg 92 has a second flange 96 projecting therefrom for engaging the caps 12 on two and one half inch outlets 13. It is emphasized that the gripper 80 is freely rotatable on the bolt 82 so as to readily seat behind the slip ring 60.

From time-to-time vandals attempt to rotate the exposed valve stem 64 (FIG. 1). After a while, the valve stem 64 can become rounded off so that the hexagonal socket 52 slips. In order to avoid slippage in such situations, the socket 52 is provided with a thumb screw 98 threaded through the wall of the socket 52 for tightening against the hexagonal nut 64 so as to achieve purchase when the nut is rounded off.

The free end of the handle 48 of activating tool 14 includes a spanner wrench portion 100 which can be used to tighten or remove rocker lugs, pin lugs, slotted hose couplings and hydrant caps (structures not shown). Thus, the actuating tool 14 negates the need for firemen to carry separate spanner wrenches for these purposes.

In addition to the gripping element 80, the tool 14 has an increased cross-sectional area in the vicinity of the hexagonal socket 52 and well as an increased wall thickness for the socket and an increase radius area in the handle 48. Moreover, the actuating tool 14 is made of a higher grade ductile iron ASTM A536 65-45-12 as cast, having a BHN hardness in the range of 217 to 235.

All patents, publications and standards cited herein are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed:

1. A fire hydrant cap for a fire hydrant outlet being mounted to an removed from said hydrant outlet by a specialized tool, said cap comprising:

a body having a domed surface formed of a carbon steel forging and heat treated to a Rockwell "C" hardness at least in the range of 50–62, the body having an internal surface and external surface;

the internal surface of the body having internal threads extending inwardly into the body for attachment to said fire hydrant outlet, the internal surface also including an annular shoulder therein;

a cadmium plated steel lock washer in the form of a split ring seated against the internal shoulder;

the external surface extending around and over the internal surface and having a curved, convex shape;

a plurality of tool engaging surfaces disposed thereon and spaced from each other and positioned on the external surface, each tool engaging surface including a shoulder facing oppositely to the direction in which the cap is threaded onto said hydrant outlet for providing shoulders for engagement by a tool having .complementary surfaces for cooperative engagement with said tool engaging surfaces for tightening said cap to said hydrant outlet when torque is applied to said tool;

each engaging surface including a recess extending from the shoulder in a direction opposite the direction in which the cap is threaded onto the hydrant, each of the recesses including a curved surface progressively increasing in distance from the axis of the body and including a side wall which extends parallel to the longitudinal axis of the cap for coacting with said tool complementary surfaces for unthreading the cap from said hydrant outlet;

an externally facing annular groove in the external surface adjacent a portion of the cap where the external and internal surfaces meet;

a slip ring forged of carbon steel and having an internally facing annular groove in alignment with the externally facing annular groove in the external surface of the cap, said slip ring having a back surface for engaging a selective gripping means disposed on said tool; and a spring steel snap ring in registration with both grooves to secure the slip ring on the cap in rotational relation therewith, and said selective gripping means cooperating with slip rings of different size caps mounted on said hydrant outlet to prevent said tool complementary surfaces from slipping off of said tool engaging surfaces when torque is applied to said tool for tightening and removal of said cap to and from said hydrant outlet.

2. The cap of claim 1, wherein space is provided between the slip ring and the cap for receiving a lubricant to facilitate slippage of the ring with respect to the cap.

3. The cap of claim 2, further including a bore in the slip ring, the bore communicating with the space between the cap and slip ring wherein lubricant can be introduced after the cap and slip ring are assembled.

4. The cap of claim 3, wherein the cap and slip ring are both forgings of 8620 carbon steel.

5. The cap of claim 1, further including in combination therewith an actuating tool, the actuating tool comprising:

a ring portion defining an internal opening and a handle extending from the ring portion for rotating the tool;

the ring portion including a plurality of actuating surfaces positioned about the internal opening for coacting with the engaging surfaces on the exterior surface of the cap for tightening and untightening the cap from a hydrant, each actuating surface including a shoulder positioned and shaped to coact with a shoulder on the cap engaging surfaces and including a curved portion positioned and shaped to coact with the curved surface on the cap engaging surface on the exterior surface of the cap;

said gripping means includes a gripper attached in proximity to the ring portion, the gripper having a portion thereon for underlying the slip ring on the cap when the tool is placed over the cap to prevent the tool from slipping from the cap.

6. The combination of claim 5, wherein the gripper is movably mounted on the handle so that the portion underlying the slip ring may be moved into operative position after the handle is placed on the cap.

7. The combination of claim 6, wherein the gripper is pivoted on the handle for rotation to operative position.

8. The combination of claim 7, wherein the actuating tool includes a hexagonal socket for opening fire hydrant valve stems, the hexagonal socket projecting from the ring portion at a location opposite that of the handle with the gripper projecting in a direction opposite that of the socket.

9. The combination of claim 8, wherein the socket includes a bolt projecting therefrom on which the gripper is freely rotatable.

10. The combination of claim 8, wherein the socket is defined by a wall and wherein the socket further includes a threaded bore through the wall thereof and a screw threaded in the bore, wherein upon tightening the screw, the socket can achieve purchase on a rounded off valve stem.

11. The combination of claim 10, wherein the handle has a free end portion and includes a spanner wrench at the free end portion thereof.

* * * * *